United States Patent [19]

Katsenes

[11] 4,091,556

[45] May 30, 1978

[54] TRIGGER SEQUENCER FOR TWIN BARREL GUNS

[76] Inventor: Philip K. Katsenes, 630 Idaho Ave., Apt. 201, Santa Monica, Calif. 90403

[21] Appl. No.: 740,814

[22] Filed: Nov. 11, 1976

[51] Int. Cl.[2] ..... F41C 19/00

[52] U.S. Cl. ..... 42/42 R

[58] Field of Search ..... 42/42 R

[56] References Cited

U.S. PATENT DOCUMENTS

| | | | |
|---|---|---|---|
| 2,203,378 | 6/1940 | Browning | 42/42 R |
| 2,233,861 | 3/1941 | Browning | 42/42 R |
| 2,711,042 | 6/1955 | Simmons | 42/42 R |
| 3,142,925 | 8/1964 | Miller | 42/42 R |
| 3,444,640 | 5/1969 | Simmons | 42/42 R |
| 3,731,416 | 5/1973 | Simple | 42/42 R |
| 3,808,724 | 5/1974 | Linde | 42/42 R |

*Primary Examiner*—Charles T. Jordan
*Attorney, Agent, or Firm*—William H. Maxwell

[57] ABSTRACT

A selector for reversibly sequencing the firing order of double barrel guns by means of a shiftable trigger linkage stepped with respect to the separate sears of the two gun barrels to be sequentially fired and with means accessible both internally and/or externally to manually set the order of firing.

10 Claims, 17 Drawing Figures

FIG. 7.
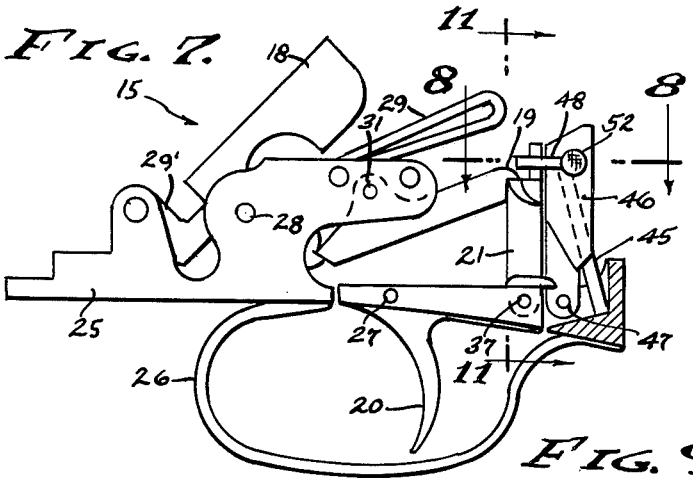
FIG. 8.
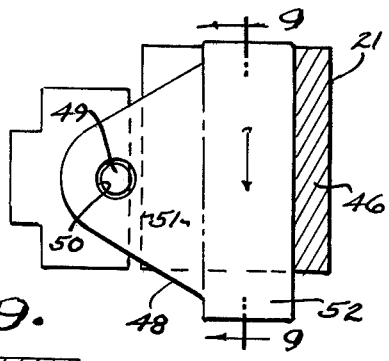
FIG. 9.
FIG. 6a.
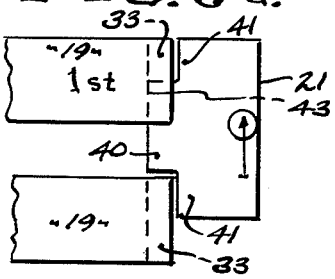
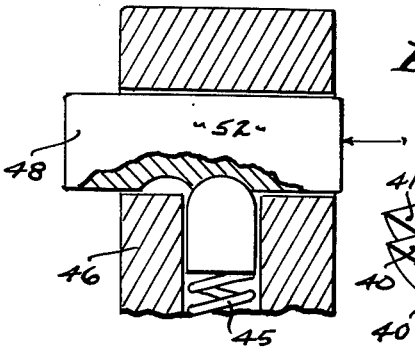
FIG. 10.
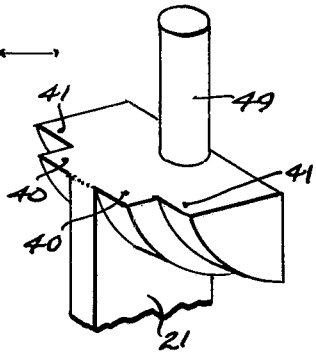
FIG. 6b.
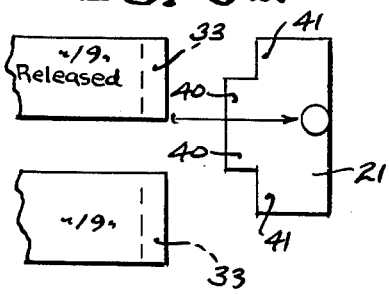
FIG. 11.
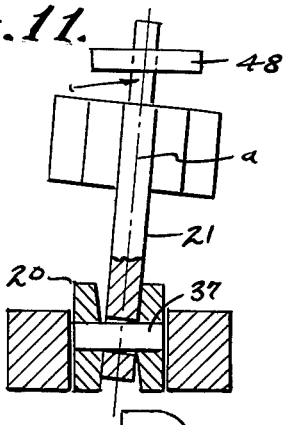
FIG. 12.
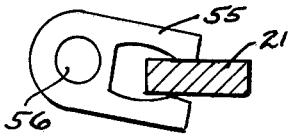
FIG. 6c.
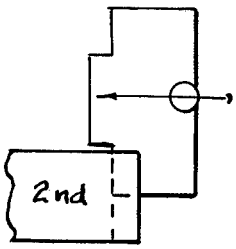
FIG. 13.
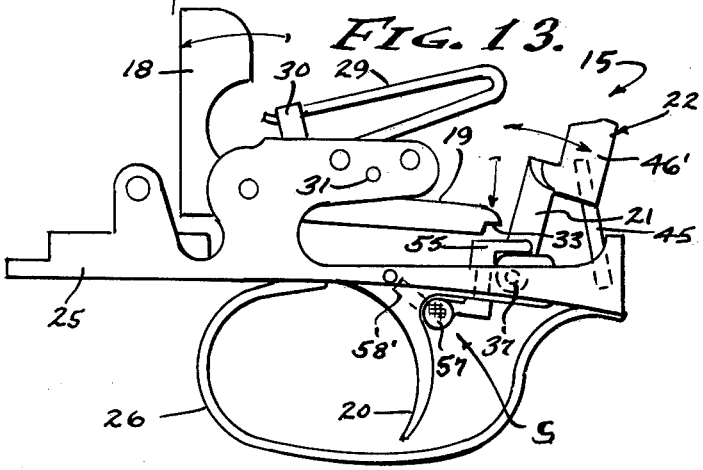

TRIGGER SEQUENCER FOR TWIN BARREL GUNS

BACKGROUND

Sporting guns, shot guns in particular, are with twin barrels of distinctive capability; for example one normal and one modified or choked. These guns are referred to as double-barrel shot guns, and the two barrels are either side by side or one over the other, the latter being an "over-under" firearm and that to which the present invention is adapted as it is hereinafter shown and described. An advantage of such guns is the selectivity of the two barrels of different character, and to this end there are guns with double triggers, and there are guns with a single sequencing trigger; and it is the latter that is preferred and to which the sequence concept of the present invention is employed.

Heretofore, recoil responsive devices have been associated with single triggers, to first fire one barrel and then the other; with the firing order predetermined and a reversed firing order requiring an alternate device and for instance the replacement of an entire trigger and hammer mechanism, or an adjustment thereto; and all of which is time consuming as it involves removal of said mechanism. Therefore, it is a general object of this invention to provide for the selective order of firing the two barrels of a double barreled firearm.

The sequential firing of double barrel guns has been accomplished with recoil responsive devices, whereby a single trigger operates one sear and then another for the consecutive release of two gun barrels in a predetermined order. However, the order of sequence has not been reversible, except by replacement and/or substantial inconvience, it being an object of this invention to facilitate selection of the firing order without replacement and/or removal of the trigger and hammer mechanism, or any part thereof or associated therewith. With the present invention, there is a switch, either internal or external, for setting the firing order of the two gun barrles.

Firing order sequencers of the type under consideration have been actuated by inertia means subject to gun recoil that repositions a stepped trigger linkage, first to release one sear and then the other. In practice, these trigger linkages have been of fixed configuration invariably operable on a line a symmetry to be consecutively engaged with and then released from each sear after firing of the barrel associated therewith respectively. As an improvement for the purposes herein set forth, it is an object of this invention to selectively shift the line of symmetry of said trigger linkage so as to effect a change or reversal in the order of firing the said two barrels. To this end, a laterally shiftable trigger linkage is provided with a pair of steps engageable with each of the two trigger sears, and means is also provided to manually set the effective position of said trigger linkage.

SUMMARY OF THE INVENTION

This invention relates to sequencing triggers for double barrel guns, and particularly shot guns with two barrels having distinctive shooting characteristics. A preferred gun of this type is the "over-under" sporting gun with a single trigger subject to recoil that sequences the order of firing. As shown, the breech of the gun breaks open at the receiver 10 so as to expose the upper and lower barrels 11 and 12 for reloading. The receiver

10 is carried by a stock 13 and a grip 14 embraces the barrels forward of the receiver. A typical shot gun of this type involves a removable trigger and hammer mechanism 15, carried in the receiver 10 to be cocked by cam means as and when the gun breech is broken open, and triggered to strike separate firing pins 16 and 17 for detonating cartridges (not shown) chambered in said barrels 11 and 12.

The trigger and hammer mechanism 15 involves the usual pairs of spring biased hammers 18 and sears 19, to be released sequentially by a trigger 20 through a stepped trigger link 21 repositioned by a recoil responsive means 22. In accordance with this invention the link 21 presents a pair of steps engageable with each sear 19, and its line of symmetry shiftable with respect to the two sears so as to reverse the order of firing. A feature of this invention is the facility for shifting the trigger link 21 by manually operable switch means, either internally or externally and preferably the latter with a laterally positionable switch S manually engageable at the base of the trigger 20.

DRAWINGS

The various objects and features of this invention will be fully understood from the following detailed description of the typical preferred forms and applications thereof, throughout which description reference is made to the accompanying drawings, in which.

Figure 5A:
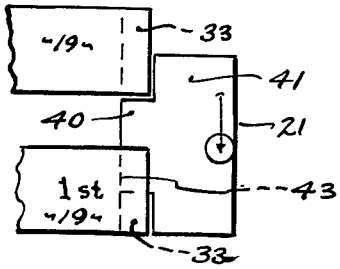
Figure 5B:
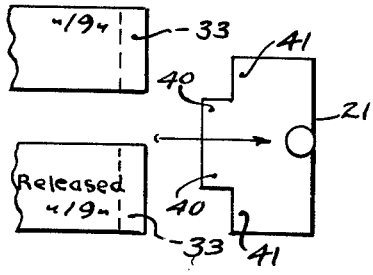
Figure 5C:
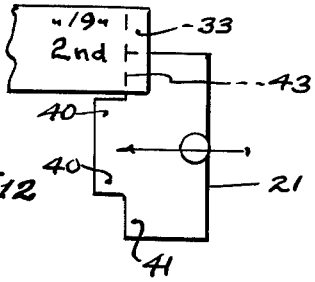

FIGS. 5*a*, 5*b*, and 5*c* are enlarged fragmentary views showing a left to right (upper to lower) order of firing.

FIGS. 6*a*, 6*b*, and 6*c* are enlarged fragmentary views showing a right to left (lower to upper) order of firing.

Figure 1:
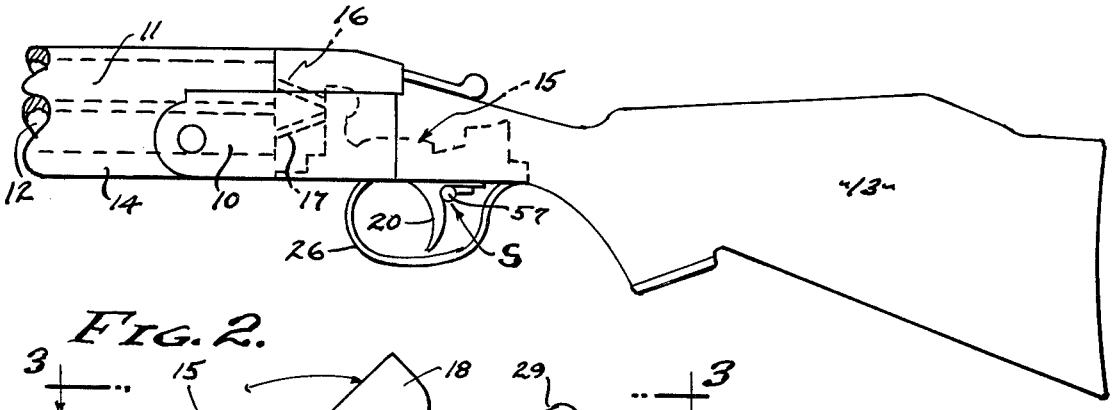
FIG. 1 is a side elevation of a double barrel gun with the trigger sequencer of the present invention installed therein.
Figure 2:
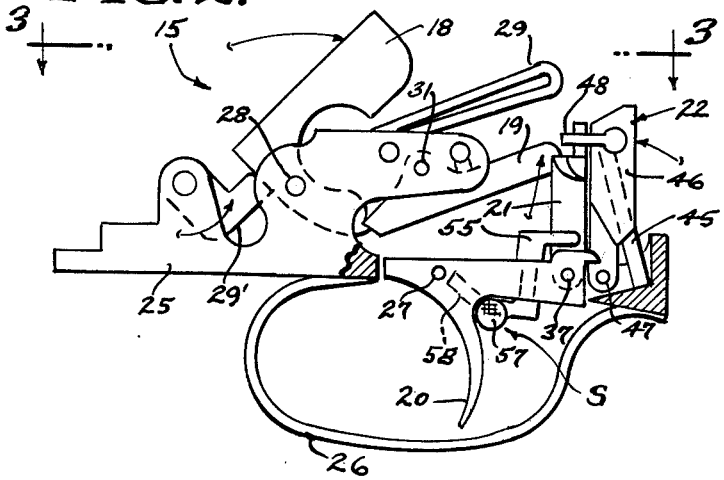
FIG. 2 is an enlarged detailed elevation of the externally set trigger sequencer removed from the gun and with the hammers in the cocked position.

FIG. 7 is a view similar to FIG. 2 showing an internally set trigger sequencer and with the hammers in the cocked position.

FIG. 8 is an enlarged plan view taken as indicated by line 8—8 on FIG. 7.

FIG. 9 is a sectional view taken as indicated by line 9—9 on FIG. 8.

FIG. 10 is an enlarged fragmentary perspective view of the trigger link and latch steps thereof which characterize the present invention.

FIG. 11 is an enlarged transverse sectional view taken as indicated by line 11—11 on FIG. 7.

Figure 4:
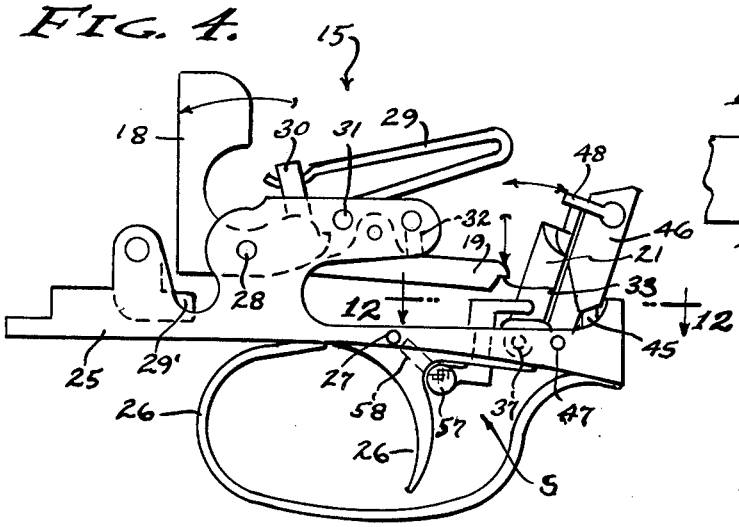
FIG. 4 is a view similar to FIG. 2 with the hammers in the released position and the recoil responsive means operated to release the sears.

FIG. 12 is an enlarged view taken substantially as indicated by line 12—12 on FIG. 4, and FIG. 13 is a view similar to FIG. 4 showing a modified form of recoil responsive means.

PREFERRED EMBODIMENT

The trigger and hammer mechanism 15 is an assembly that is removeably installed in the receiver 10, and is shown removed therefrom in FIGS. 2–4, 7 and 13. The mechanism 15 involves a frame 25 by which the parts and elements of the present invention are carried in cooperative relation open with the other, there being a trigger ring 26 depending from the frame to protectively surround trigger 20 and the selector switch S. The single trigger 20 is pivoted to the frame 25 by a pin 27, and forward thereof the two hammers 18 are pivoted side by side on a common pin 28. As shown, there is a pair of cams 29' operated by a cocking slide (not shown) to force the hammers rearwardly against the bias of separate springs 29 individually connected thereto by shackles 30. Revolvement of the hammer 18 into the cocked position shown in FIGS. 2 and 7 engages the sear 19 in each instance, the sear being pivoted to the frame by a pin 31 and biased by a spring 32 (see FIG. 4) into latched engagement with the hammer in each instance. A feature is the second class lever configuration of the sear 19 that extends rearwardly and upwardly to a downwardly faced shoulder 33, in each instance coplanar and in alignment one with the other when in the cocked positions respectively. The sears 19 are spaced a substantial lateral distance by means of a central webb 34 of the frame, and the shoulders 33 thereof are positioned substantially rearward of the trigger 20 and over the rear attachment of the trigger ring 26. It is the order of engagement of the two coplanar and aligned shoulders 33 with which this invention is primarily concerned, as will now be described.

By comparing FIGS. 2 and 4 of the drawings it will be observed that the raised cocked position of the shoulder 33 and released position thereof provides a separation between which the latch steps of the trigger linkage can be ineffective. Accordingly, the trigger 20 is a third class lever moved rearward and upward by its depending finger pull so as to rise beneath the shoulder 33 where it swively carries the upstanding trigger link 21. As shown, the link 21 is secured to an upstanding bifurcated rear portion of the trigger 20 (see FIG. 11) and connected thereto by a pin 37 which permits lateral as well as fore and aft swinging movement thereof. The link 21 is flattened with clearance between the spaced and upwardly divergent flanges of the trigger that permit said compound movements, as well as some turning on a shiftable axis *a* of symmetry.

In accordance with this invention, the link 21 is bi-laterally symmetrical with opposite pairs of coplanar latch steps 40 and 41 releasably engageable with the laterally spaced sear shoulders 33. As shown, there is a pair of transverse inner steps 40 displaced angularly forward in alignment with each other, and there is a pair of transverse outer steps 41 displaced angularly rearward in alignment with each other. That is, the steps 40 an 41 are displaced angularly relative to each other so that positioned engagement of one inner step 40 beneath the shoulder 33 of one sear 19 restrains the opposite outer step 41 from engaging beneath the shoulder 33 of the other sear 19, and vice versa. As shown, a stop 43 adjoins each shoulder 33 to position the latch step that swings into engagement therewith.

A feature is the recoil responsive means 22 that releases the sears 19 to the uncocked position shown in FIGS. 4 and 13. As shown, the trigger link 21 is free to swing rearwardly against the forward bias of a spring means 45, there being an inertia block 46 attached thereto. As a result of recoil, the block 46 continues to draw the link 21 and its latch steps 40 and 41 rearwardly and out of engagement with the shoulders 33, thereby releasing the sears. In carrying out this invention, the inertia block 46 can be a separate lever pivoted to the frame 25 by a pin 47 and coupled to the trigger link 21 by means of a stirrup 48 that positions or permits lateral shifting and positioning of the link 21, as later described. The spring means 45 is shown as a spring biased strut that is extensible to yieldingly urge the trigger link forwardly to engage the latch steps 40 and 41 with the stops 43.

The order of engagement of the two coplanar and aligned shoulders 33 is selectively determined by shifting the position of the trigger link 21 from side to side. In carrying out this invention, the link 21 is shifted to one side positioned by either coupling flange of the trigger 20 with the latch step 40 at one side of the link 21 firstly engageable beneath the shoulder 33 of one sear, while the latch step 40 at the other side of the link 21 is inoperative with latch step 41 held clear of the shoulder 33 of the other sear by virtue of its angular displacement due to the engagement of the first mentioned step 40 with the stop 43. Firing of the first barrel causes gun recoil which releases the said firstly engageable sear, permitting it to rotate out of coplanar alignment with the latch step 40 and into the uncocked position shown in FIGS. 4 and 13. Now therefore, the latch step 41 at the other side of the link 21 is secondly engageable with the shoulder 33 of the other sear for firing of the second barrel.

Figure 3:
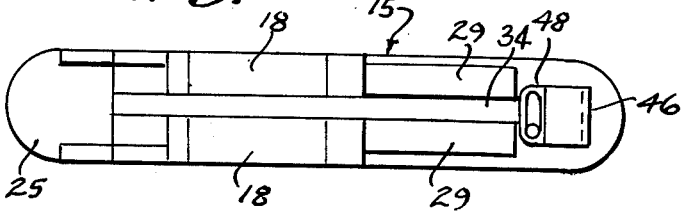
FIG. 3 is a plan view of the trigger sequencer taken as indicated by line 3—3 on FIG. 2.

FIG. 13 of the drawings illustrates the direct application of the inertia block 46' to the trigger link 21, while FIGS. 2–4 illustrate a separate and more conventional inertia block 46 with the stirrup 48 acting as a coupling (see FIG. 3). Internal selection of the order of firing is illustrated in FIGS. 7–9 where the stirrup 48 is laterally shiftable into two extreme side positions (see FIG. 9) with the post 49 located through a guide opening 50 in a forwardly projecting ear 51 thereof. The stirrup 48 is swively anchored to the body 46 on a transverse axis, as by means of a cylindrical enlargement 52 from which the ear 51 freely projects through a slot in said body. The two extreme positions of the stirrup 48 are determined by detents in said cylinder yieldingly engaged by the terminal end of the spring means 45. In practice, the stirrup 48 is wider than the body 46, so as to be manually depressed laterally flush therewith and into said two extreme positions respectively.

In accordance with the preferred form of this invention, the order of firing is selected externally by means of the selector switch S located on and carried at the base of the trigger 20. Accordingly, there is a shifting fork 55 that embraces the trigger link 21 above the coupling pin 37. The trigger link 21 is flat sided and guided by the fork 55 to swing laterally from side to side, as controlled by a shaft 56 extending through the trigger 20 forward of the coupling pin 37. The switch S per se is in the form of a head 57 exposed at the base of the trigger pull and widened so as to be manually depressed flush into two extreme positions held by detent means 58 projecting from the base of the trigger and yieldingly engageable therewith. Thus, it will be seen that the switch S selectively shifts the axis of symmetry of the said trigger link, to firstly engage one pawl 19 or the other as circumstances require.

Having described only typical preferred forms and applications of my invention, I do not wish to be limited or restricted to the specific details herein set forth, but wish to reserve to myself and modifications or variations that may appear to those skilled in the art.

I claim:

1. A selector for reversibly sequencing the firing order of a single trigger double barrel gun having a pair of laterally spaced sears and each releasable from a hammer held thereby in a cocked position to strike a firing pin and dishcharge a barrel, each sear being a lever with a shoulder coplanar one with the other when in cocked positions respectively, and each sear rotatable to an uncocked position when released from the hammer, the trigger being a lever carrying a trigger link in opposition to the shoulders of the sears to release the sears from the hammer, and including; means swively coupling the trigger link to the trigger for lateral as well as fore and aft swinging movement thereof between the sears, spring means biasing the trigger link forwardly, two pairs of laterally oppposite coplanar transversely aligned latch steps on said trigger link, a pair of forwardly displaced inner latch steps and a pair of rearwardly displaced outer latch steps, means for positioned engagement of one inner latch step beneath the shoulder of one sear while holding the opposite inner latch step positioned from engagement beneath the shoulder of the other sear and while restraining the opposite outer latch step for subsequent positioned engagement beneath the shoulder of said other sear, operation of the trigger acting to engage the latch step beneath the shoulder of a sear to release it and the said hammer held thereby, and recoil means comprised of a separate inertia body pivoted to swing fore and aft and coupled to the trigger link by a manually shiftable stirrup slideable laterally of the said inertia body and extending therefrom with a guide opening engaged over a post projecting from the said trigger link, said recoil means being responsive to discharge of a barrel and applied to said trigger link to swing it aft and retract the latch step engaged with the shoulder of a sear for release of said sear to said uncocked position and returned by said spring means for repositioned engagement of the said opposite outer latch step beneath the shoulder of the other sear after firing the first barrel by operating the trigger to release a sear and hammer with engagement of said first mentioned inner latch step.

2. The firing order selector for a double barrel gun as set forth in claim 1, wherein the recoil means includes detent means for selective opposite positioning of the trigger link with an inner latch step beneath a sear shoulder.

3. The firing order selector for a double barrel gun as set forth in claim 1, wherein the means swively coupling the trigger link to the trigger comprises spaced upwardly divergent flanges limiting lateral movement of the trigger link with a pivot pin rotatably carrying the trigger link to swing freely fore and aft.

4. An exteriorly operable selector for reversibly sequencing the firing order of a single trigger double barrel gun having a pair of laterally spaced sears and each releasable from a hammer held thereby in a cocked position to strike a firing pin and discharge a barrel, each sear being a lever with a shoulder coplanar one with the other when in cocked positions respectively, and each sear rotatable to an uncocked position when released from the hammer, the trigger being a lever carrying a trigger link in opposition to the shoulders of the sears to release the sears from the hammer, and including; means swively coupling the trigger link to the trigger for lateral as well as fore and aft swinging movement thereof between the sears, spring means biasing the trigger link forwardly, two pairs of laterally opposite coplanar transversely aligned latch steps on said trigger link, a pair of forwardly displaced inner latch steps and a pair of rearwardly displaced outer latch steps, means selectively positioning the trigger link laterally and including a shifting fork engaged therewith and operated by a switch means carried by and exteriorly exposed at the base of the trigger for positioned engagement of one inner latch step beneath the shoulder of one sear while holding the opposite inner latch step positioned from engagement beneath the shoulder of the other sear and while restraining the opposite outer latch step for subsequent positioned engagement beneath the shoulder of said other sear, operation of the trigger acting to engage the latch step beneath the shoulder of a sear to release it and the said hammer held thereby, and recoil means responsive to discharge of a barrel and applied to said trigger link to swing it aft and retract the latch step engaged with the shoulder of a sear for release of said sear to said uncocked position and returned by said spring means for repositioned engagement of the said opposite outer latch step beneath the shoulder of the other sear after firing the first barrel by operating the trigger to release a sear and hammer with engagement of said first mentioned inner latch step.

5. The exteriorly exposed firing order selector for a double barrel gun as set forth in claim 4, wherein the trigger link is selectively positioned laterally by the shifting fork engaged therewith and operated by a shaft carried through the base of the trigger, with a switch head exposed exteriorly for manual positioning.

6. The exteriorly exposed firing order selector for a double barrel gun as set forth in claim 4, wherein the means selectively positioning the trigger link includes detent means for selective opposite positioning of a switch head exposed exteriorly for manual positioning.

7. The exteriorly exposed firing order selector for a double barrel gun as set forth in claim 4, wherein the means swively coupling the trigger link to the trigger comprises spaced upwardly divergent flanges limiting lateral movement of the trigger link with a pivot pin rotatably carrying the trigger link to swing freely fore and aft.

8. The exteriorly exposed firing order selector for a double barrel gun as set forth in claim 4, wherein the means swively coupling the trigger link to the trigger comprises spaced upwardly divergent flanges limiting lateral movement of the trigger link with a pivot pin rotatably carrying the trigger link to swing freely fore and aft, wherein the recoil means comprises a separate inertia body pivoted to swing fore and aft and coupled to the trigger link by a stirrup extending from said inertia body with an opening engaged over a post projecting from the said trigger link.

9. The exteriorly exposed firing order selector for a double barrel gun as set forth in claim 4, wherein the means swively coupling the trigger link to the trigger comprises spaced upwardly divergent flanges limiting lateral movement of the trigger link with a pivot pin rotatably carrying the trigger link to swing freely fore and aft, wherein the recoil means comprises a separate inertia body pivoted to swing fore and aft and coupled to the trigger link by a manually shiftable stirrup slideable laterally of the said inertia body and extending therefrom with a guide opening engaged over a post projecting from the said trigger link, and wherein the trigger link is selectively positioned laterally by the shifting fork engaged therewith and operated by a shaft carried through the base of the trigger, with a switch head exposed exteriorly for manual positioning.

10. The exteriorly exposed firing order selector for a double barrel gun as set forth in claim 4, wherein the means swively coupling the trigger link to the trigger comprises spaced upwardly divergent flanges limiting lateral movement of the trigger link with a pivot pin rotatably carrying the trigger link to swing freely fore and aft, wherein the recoil means comprises a separate inertia body pivoted to swing fore and aft and coupled to the trigger link by a manually shiftable stirrup slideable laterally of the said inertia body and extending therefrom with a guide opening engaged over a post projecting from the said trigger link, and with detent means for selective opposite positioning of the trigger link with an inner latch step beneath a sear shoulder, and wherein the trigger link is selectively positioned laterally by the shifting fork engaged therewith and operated by a shaft carried through the base of the trigger, with a switch head exposed exteriorly for manual positioning, and with detent means for selective opposite positioning of the switch head.

* * * * *